US011317735B1

(12) United States Patent
Cheng

(10) Patent No.: US 11,317,735 B1
(45) Date of Patent: May 3, 2022

(54) ANTI-MISOPERATION COMBINED DINING CHAIR FOR CHILDREN

(71) Applicant: Pao-Hsien Cheng, Taipei (TW)

(72) Inventor: Pao-Hsien Cheng, Taipei (TW)

( * ) Notice: Subject to any disclaimer, the term of this patent is extended or adjusted under 35 U.S.C. 154(b) by 23 days.

(21) Appl. No.: 17/137,469

(22) Filed: Dec. 30, 2020

(30) Foreign Application Priority Data

Nov. 27, 2020 (CN) ..... 202022795892.2

(51) Int. Cl.
*A47D 1/10* (2006.01)
*A47D 1/00* (2006.01)
*A47D 1/04* (2006.01)

(52) U.S. Cl.
CPC ..... *A47D 1/106* (2013.01); *A47D 1/006* (2013.01); *A47D 1/04* (2013.01); *A47D 1/10* (2013.01); *A47D 1/0085* (2017.05); *Y10T 403/59* (2015.01); *Y10T 403/608* (2015.01)

(58) Field of Classification Search
None
See application file for complete search history.

(56) References Cited

U.S. PATENT DOCUMENTS 3,913,976 A * 10/1975 Plancher ..... A47D 1/004 248/354.2
4,971,474 A * 11/1990 Sprague ..... B64G 1/641 403/381
5,497,965 A * 3/1996 Mathieu, Jr. ..... F16M 11/041 403/327
6,089,654 A * 7/2000 Burstein ..... A47D 1/08 297/133
11,202,518 B1 * 12/2021 Lo ..... A47D 11/002
2011/0074187 A1 * 3/2011 Zhong ..... A47D 1/103 297/130
2012/0104193 A1 * 5/2012 Cheng ..... A47B 13/021 248/188.8
2018/0263379 A1 * 9/2018 Cheng ..... A47D 1/103
2021/0401189 A1 * 12/2021 Yang ..... A47D 3/00

* cited by examiner

*Primary Examiner* — David E Allred
(74) *Attorney, Agent, or Firm* — Cooper Legal Group, LLC

(57) ABSTRACT

The disclosure discloses an anti-misoperation combined dining chair for children. The dining chair comprises a seat and a tabletop which are arranged in sequence on a supporting component. The support component comprises four No. 1 supporting tubes and No. 2 supporting tubes. One end of each of the four No. 1 supporting tubes is respectively inserted into one of four corners of the seat, and the other end of each of the four No. 1 supporting tubes is internally provided with a corresponding No. 2 supporting tube in an inserting manner respectively. The tabletop is arranged at peripheries of the No. 2 supporting tubes in a sleeved manner and is connected with the No. 1 supporting tubes and the No. 2 supporting tubes through locking mechanisms respectively.

10 Claims, 3 Drawing Sheets

ANTI-MISOPERATION COMBINED DINING CHAIR FOR CHILDREN

CROSS-REFERENCE TO RELATED APPLICATIONS

This application claims priority to Chinese Patent Application 202022795892.2, filed on Nov. 27, 2020, which is incorporated herein by reference.

TECHNICAL FIELD

The application relates to the relevant field of combined dining chairs, and in particular to anti-misoperation combined dining chairs for children.

BACKGROUND

A dinning chair for the children refers to a special chair for the children during dining, also referred to as a high chair. The locking mechanisms of a traditional upper and lower combined dining chair for the children are directly exposed to the outsides. Because being younger and more active, the children who dine in chairs will be likely to unlock chairs due to accidental touch, which may lead to the risk of separating upper and lower components. As a result, there will be great potential safety hazards in use.

SUMMARY

An objective of the disclosure is to provide an anti-misoperation combined dining chair for children to solve the problems proposed in the above technical background.

In order to achieve the above objective, the disclosure provides the following technical solution:

The anti-misoperation combined dining chair for the children includes a seat and a tabletop which are arranged in sequence on a supporting component. The support component includes four No. 1 supporting tubes and No. 2 supporting tubes, one ends of the four No. 1 supporting tubes are respectively inserted into four corners of the seat, the other ends of the four No. 1 supporting tubes are internally provided with the No. 2 supporting tubes in an inserting manner respectively, and the tabletop is arranged at the peripheries of the No. 2 supporting tubes in a sleeved manner and is connected with the No. 1 supporting tubes and the No. 2 supporting tubes through locking mechanisms respectively; and each locking mechanism includes a sliding sleeve, a No. 1 pin, an arc hook, a tube plug, a locking hook and a No. 2 pin, wherein one end of the locking hook is hinged to the tabletop through the No. 2 pin, the middle part of the locking hook is connected with a step on the tabletop in a clamping manner, the other end of the locking hook is connected with a limiting groove of the tube plug sleeved on the periphery of the corresponding No. 2 supporting tube in the clamping manner, one side of the end part of the locking hook is further in contact with one end of the arc hook, and the other side of the end part of the locking hook is in contact with the inner wall of the sliding sleeve, wherein the middle part of the arc hook is rotationally connected with the tube plug through a No. 1 pin, the sliding sleeve is arranged at the periphery of the inner wall of the corresponding No. 1 supporting tube in a sleeved manner, is in sliding connected with the corresponding No. 1 supporting tube and is connected with the corresponding No. 2 supporting tube through a reset component;

As a further solution of the disclosure, each reset component includes a limiting rod and a spring, two ends of each limiting rod are arranged on the inner wall of the corresponding No. 2 supporting tube in the sleeved manner, and the bottom of one end of each limiting rod is connected with the step at the bottom of the corresponding sliding sleeve through the corresponding spring.

As a further solution of the disclosure, each tube plug is further connected with the corresponding sliding sleeve through a blind rivet.

As a further solution of the disclosure, a filler in a backrest of the seat is foam plastics.

As a further solution of the disclosure, the bottom of each No. 2 supporting tube is provided with an anti-skid pad.

Compared with the prior art, the disclosure has the beneficial effects that:

By arranging the locking mechanisms, the disclosure can cover the unlocked locking hooks in the locked state, so that great potential safety hazards in use caused by the risk that the tabletop, the No. 1 supporting tubes and the No. 2 supporting tubes are separated from each other due to unlocking by misoperation of children or parents are avoided.

Figure 1:
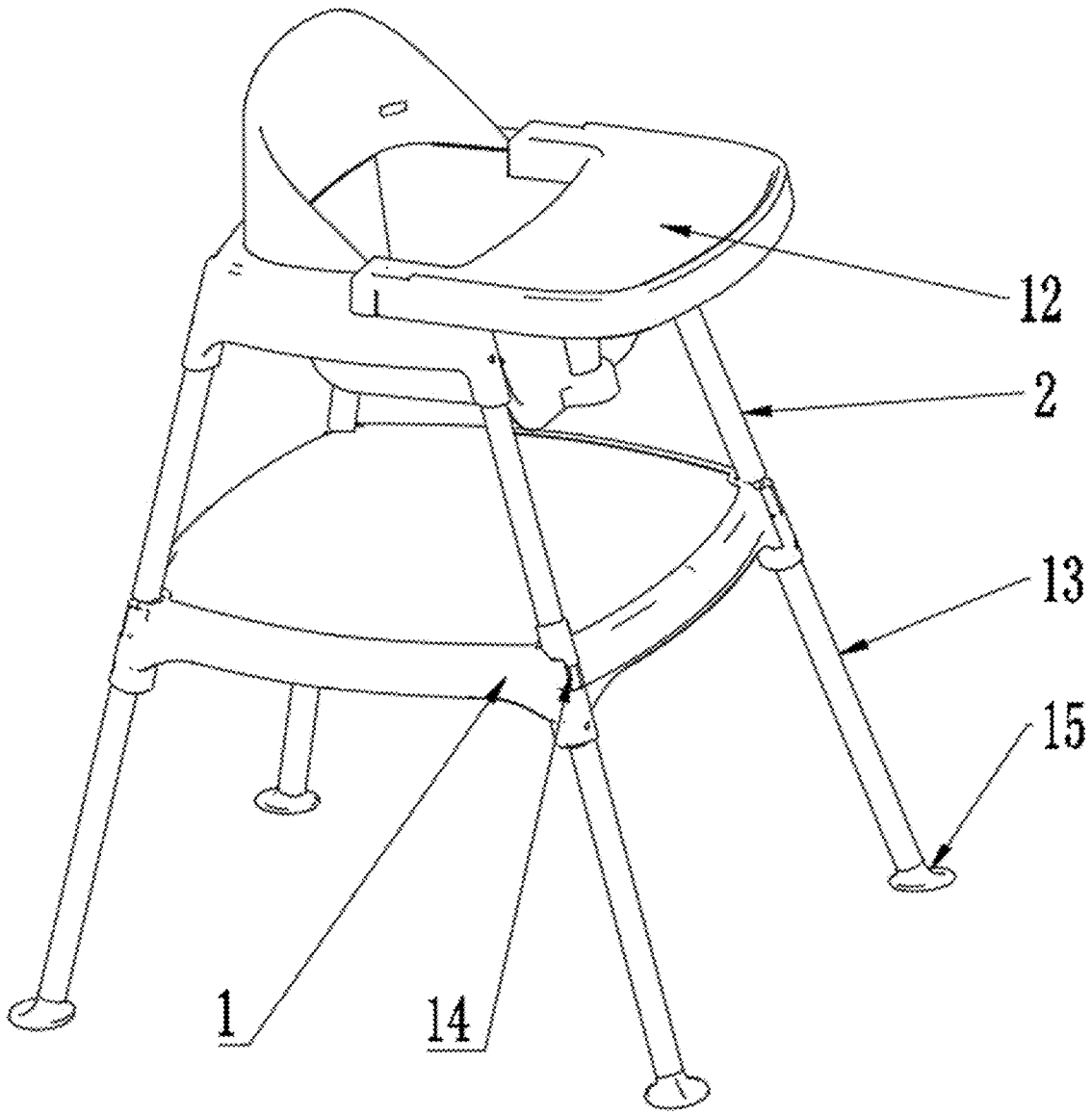
FIG. 1 is an overall three-dimensional diagram of a dining chair for children.

Reference numeral notes: 1—tabletop, 2—No. 1 supporting tube, 3—arc hook, 4—limiting rod, 5—spring, 6—No. 1 pin, 7—tube plug, 8—blind rivet, 9—sliding sleeve, 10—No. 2 pin, 11—locking hook, 12—seat, 13—No. 2 supporting tube, 14—locking mechanism, 15—anti-skid pad.

DETAILED DESCRIPTION

The disclosure will be described in detail by the following embodiments with reference to the drawings. In the drawings or specification, similar or identical parts are marked with the same numbers, and in practical applications, the shape, thickness or height of each part can be enlarged or reduced. Various embodiments listed herein are only used to illustrate the disclosure, and not to limit the scope of the disclosure. Any obvious modification or change made to the disclosure does not deviate from the principles and scope of the disclosure.

Figure 2:
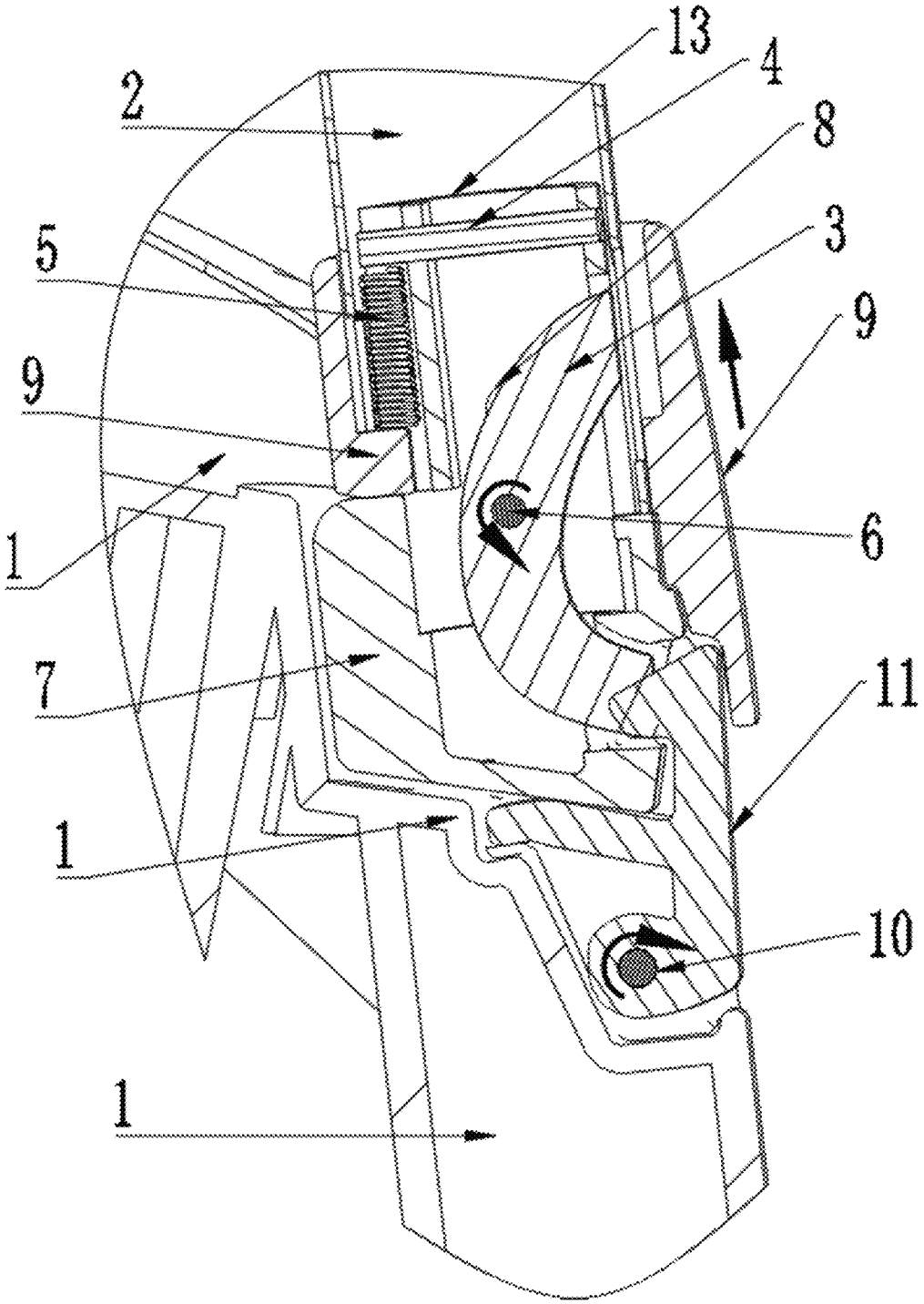
FIG. 2 is a schematic structural diagram of locking mechanisms of the dining chair for children.
Figure 3:
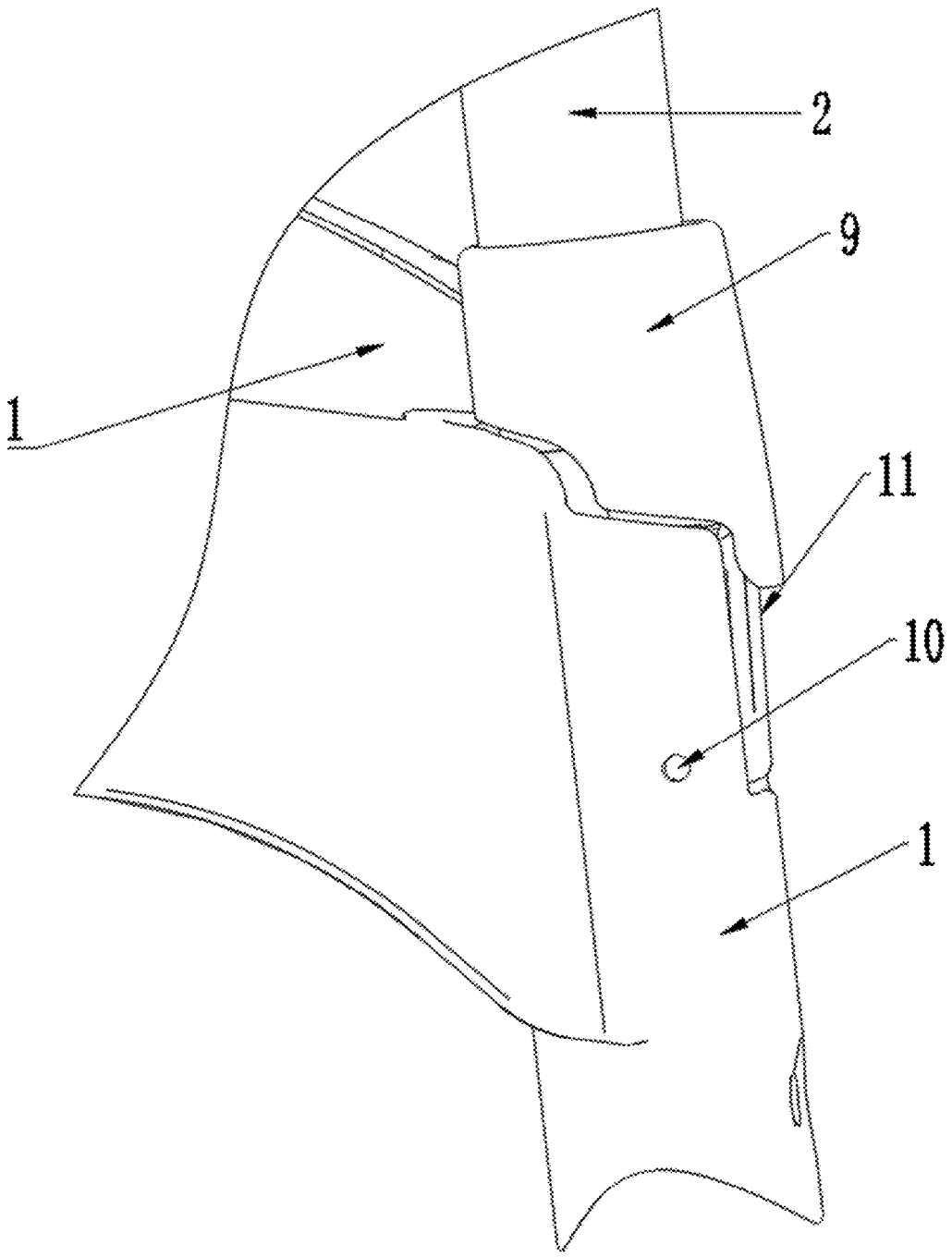
FIG. 3 is a partial structural diagram of the dining chair for children.

Please refer to FIGS. 1-3. In one embodiment of the disclosure, an anti-misoperation combined dining chair for children includes a seat 12 and a tabletop 1, which are arranged in sequence on a supporting component. The support component includes four No. 1 supporting tubes 2 and No. 2 supporting tubes 13. One end of each of the No. 1 supporting tubes 2 is respectively inserted into four corners of the seat 12, and the other end of each of the No. 1 supporting tubes 2 is internally provided with a corresponding one of the No. 2 supporting tubes 13 in an inserting manner. The tabletop 1 is arranged at the peripheries of the No. 2 supporting tubes 13 in a sleeved manner and is connected with the No. 1 supporting tubes 1 and the No. 2 supporting tubes 13 through locking mechanisms 14 respectively. Each locking mechanism 14 includes a sliding sleeve 9, a No. 1 pin 6, an arc hook 3, a tube plug 7, a locking hook 11 and a No. 2 pin 10. One end of the locking hook 11 is hinged to the tabletop 1 through the No. 2 pin 10, and the middle part of the locking hook 11 is connected with a step on the tabletop 1 in a clamping manner. The other end of the locking hook 11 is connected with a limiting groove of the tube plug 7 sleeved on the periphery of the corresponding No. 2 supporting tube 13 in the clamping manner, and one side of the end part of the locking hook 11 is in contact with one end of the arc hook 3. The other side of the end part of the locking hook 11 is in contact with the inner wall of a sliding sleeve 9, The middle part of the arc hook 3 is rotationally connected with the tube plug 7 through a No. 1 pin 6. The sliding sleeve 9 is sleeved on the periphery of the corresponding No. 1 supporting tube 2, is in sliding connection with the corresponding No. 1 supporting tube 2 and is connected with the corresponding No. 2 supporting tube 13 through a reset component.

In this embodiment, each reset component includes a limiting rod 4 and a spring 5. Two ends of each limiting rod 4 are arranged on the inner wall of the corresponding No. 2 supporting tube 13 in the inserting manner, and the bottom of one end of each limiting rod 4 is connected with the step at the bottom of the corresponding sliding sleeve 9 through the corresponding spring 5.

In this embodiment, each tube plug 7 is further connected with the corresponding sliding sleeve 9 through a blind rivet 8.

During locking, the whole state is as shown in FIG. 1-3, and each sliding sleeve 9 will cover the corresponding locking hook 11, so that each locking hook 11 cannot be touched and locked due to misoperation. When unlocking is needed, please refer to FIG. 2, two sides of each sliding sleeve 9 are pinched by a thumb and a forefinger. Each sliding sleeve 9 is moved in a direction indicated by an arrow in the figures and pushes the corresponding arc hook 3 to rotate around the corresponding pin 6 in a direction indicated by an arrow in the figures, and at the same time, the lower side of each arc hook 3 pushes the corresponding locking hook 11 to rotate in a direction indicated by an arrow in the figures to separate the corresponding locking hook 11 from the tabletop 1 and the corresponding tube plug 7, so that unlocking is realized.

To sum up, by arranging the locking mechanisms 14, the unlocked locking hooks 11 can be covered in the locked state, so that great potential safety hazards in use caused by the risk that the tabletop 1, the No. 1 supporting tubes 2 and the No. 2 supporting tubes 13 are separated from each other due to unlocking by misoperation of children or parents are avoided.

As an embodiment of the disclosure, a filler in the backrest of the seat 12 is foam plastics. The foam plastics have the advantages of light weight, strong adsorption capacity, no breakage, strong decontamination capacity, long service life and the like. In practical application, other materials can also be selected as fillers to fill the backrest according to demands.

Please refer to FIG. 1, as an embodiment of the disclosure, an anti-skid pad 15 is arranged at the bottom of each No. 2 supporting tube 13, and thus achieving the anti-skid effect.

All standard parts used in the disclosure can be purchased in the market, and special-shaped parts can be customized as mentioned in the specification and the drawings. Mature conventional means, such as bolts, rivets and welding, in the prior art are adopted in specific connection modes of each part. Conventional models in the prior art are adopted by machinery, parts and equipment. In addition, conventional connection modes in the prior art are adopted by circuit connection, which will not be described in detail herein.

It is obvious to those skilled in the art that the disclosure is not limited to the details of the above exemplary embodiments, and the disclosure can be embodied in other specific forms without departing from the spirit or essential characteristics thereof. Therefore, all the embodiments shall be regarded as exemplary rather than restrictive in all respects, and the scope of the disclosure is defined by the appended claims instead of the above specification. Therefore, it is intended to embrace all changes falling within the meaning and scope of the equivalent elements of the claims in the disclosure.

Furthermore, it is should be understood that although this specification is described according to embodiments, not all the embodiments contain one independent technical solution only. The description manner of the specification is only for the sake of clarity, and those skilled in the art shall take the specification as a whole. The technical solutions in various embodiments can also be combined appropriately to form other embodiments that can be understood by those skilled in the art.

What is claimed is:

1. An anti-misoperation combined dining chair for children comprises a seat and a tabletop which are sequentially arranged, wherein:

the seat and the tabletop are both installed on a supporting component, the supporting component comprises four No. 1 supporting tubes and No. 2 supporting tubes, one end of each of the four No. 1 supporting tubes is respectively inserted into one of four corners of the seat, the other end of each of the four No. 1 supporting tubes is internally provided with a corresponding No. 2 supporting tube in an inserting manner, the tabletop is arranged at peripheries of the No. 2 supporting tubes in a sleeved manner and is connected with the No. 1 supporting tubes and the No. 2 supporting tubes through locking mechanisms respectively, each locking mechanism comprises a sliding sleeve, a No. 1 pin, an arc hook, a tube plug, a locking hook and a No. 2 pin, one end of the locking hook is hinged to the tabletop through the No. 2 pin, a middle part of the locking hook is connected with a step on the tabletop in a clamping manner, the other end of the locking hook is connected with a limiting groove of the tube plug sleeved on a periphery of the corresponding No. 2 supporting tube, one side of the other end of the locking hook is also in contact with one end of the arc hook, the other side of the other end of the locking hook is in contact with an inner wall of the sliding sleeve, wherein the middle part of the arc hook is rotationally connected with the tube plug through the No. 1 pin, and the sliding sleeve is sleeved on a periphery of a corresponding No. 1 supporting tube, is in sliding connection with the corresponding No. 1 supporting tube and is connected with the corresponding No. 2 supporting tube through a reset component.

2. The anti-misoperation combined dining chair for the children according to claim 1, wherein:

each reset component comprises a limiting rod and a spring, two ends of each limiting rod are arranged on an inner wall of the corresponding No. 2 supporting tube in an inserting manner, and a bottom of one end of each limiting rod is connected with a step of a bottom of a corresponding sliding sleeve through a corresponding spring.

3. The anti-misoperation combined dining chair for the children according to claim 1, wherein each tube plug is further connected with a corresponding sliding sleeve through a blind rivet.

4. The anti-misoperation combined dining chair for the children according to claim 1, wherein a filler in a backrest of the seat is foam plastics.

5. The anti-misoperation combined dining chair for the children according to claim 1, wherein a bottom of each No. 2 supporting tube is provided with an anti-skid pad.

6. The anti-misoperation combined dining chair for the children according to claim 2, wherein each tube plug is further connected with the corresponding sliding sleeve through a blind rivet.

7. The anti-misoperation combined dining chair for the children according to claim 2, wherein a filler in a backrest of the seat is foam plastics.

8. The anti-misoperation combined dining chair for the children according to claim 3, wherein a filler in a backrest of the seat is foam plastics.

9. The anti-misoperation combined dining chair for the children according to claim 2, wherein a bottom of each No. 2 supporting tube is provided with an anti-skid pad.

10. The anti-misoperation combined dining chair for the children according to claim 3, wherein a bottom of each No. 2 supporting tube is provided with an anti-skid pad.

* * * * *